US008469116B2

(12) United States Patent
Larson

(10) Patent No.: US 8,469,116 B2
(45) Date of Patent: Jun. 25, 2013

(54) CONTROL SYSTEM FOR MUD CLEANING APPARATUS

(75) Inventor: Thomas Robert Larson, Montgomery, TX (US)

(73) Assignee: National Oilwell Varco, L.P., Houston, TX (US)

( * ) Notice: Subject to any disclaimer, the term of this patent is extended or adjusted under 35 U.S.C. 154(b) by 235 days.

(21) Appl. No.: 12/847,431

(22) Filed: Jul. 30, 2010

(65) Prior Publication Data

US 2012/0024602 A1 Feb. 2, 2012

(51) Int. Cl.
*E21B 7/00* (2006.01)
*E21B 21/06* (2006.01)

(52) U.S. Cl.
USPC ..... 175/57; 175/66; 175/206; 175/207

(58) Field of Classification Search
USPC ..... 175/57, 65, 206, 207, 66
See application file for complete search history.

(56) References Cited

U.S. PATENT DOCUMENTS

| | | | | |
|---|---|---|---|---|
| 4,295,525 | A | 10/1981 | Swift et al. | |
| 4,844,812 | A * | 7/1989 | Haynes et al. | 210/741 |
| 5,006,239 | A * | 4/1991 | Mishra | 210/181 |
| 6,073,709 | A * | 6/2000 | Hensley | 175/207 |
| 6,102,310 | A * | 8/2000 | Davenport | 241/21 |
| 6,357,536 | B1 | 3/2002 | Schrader et al. | |
| 6,926,101 | B2 * | 8/2005 | deBoer | 175/70 |
| 7,367,411 | B2 * | 5/2008 | Leuchtenberg | 175/48 |
| 7,568,535 | B2 | 8/2009 | Larson et al. | |
| 2003/0000704 | A1 | 1/2003 | Reynolds | |
| 2008/0083566 | A1 * | 4/2008 | Burnett | 175/66 |
| 2008/0283295 | A1 * | 11/2008 | Eia | 175/46 |
| 2009/0120846 | A1 * | 5/2009 | Burnett | 209/44 |
| 2009/0145664 | A1 * | 6/2009 | Larson et al. | 175/65 |
| 2010/0089802 | A1 * | 4/2010 | Burnett | 209/360 |

FOREIGN PATENT DOCUMENTS

WO 2008058540 5/2008

OTHER PUBLICATIONS

International Application No. PCT/US2011/043193, Search Report and Written Opinion dated Feb. 23, 2012, 7 pages.

* cited by examiner

*Primary Examiner* — Giovanna Wright
*Assistant Examiner* — Michael Wills, III
(74) *Attorney, Agent, or Firm* — Conley Rose, P.C.

(57) ABSTRACT

Techniques for controlling drilling fluid cleaning apparatus that reclaim lost circulation material from spent drilling fluid are disclosed. In one embodiment, a system includes a tank, a density separation device, and a fluid density control system. The tank holds spent drilling fluid containing drilling fluid, lost circulation material, coarse solids and fine solids. The density separation device is coupled to an outlet of the tank. The density separation device provides an overflow stream and an underflow stream. The overflow stream contains less dense material than the underflow stream. The fluid density control system is configured to adjust the density of the spent drilling fluid provided to the density separation device by recirculating a portion of the underflow stream into the tank.

17 Claims, 3 Drawing Sheets

CONTROL SYSTEM FOR MUD CLEANING APPARATUS

BACKGROUND

Drilling fluid, often called "mud," is, typically, a mixture of fluid and various additives which is pumped down through a hollow drill string (pipe, drill collar, bit, etc.) into a well being drilled and exits through ports or nozzles in the drill bit. The mud picks up drilled cuttings, debris, and other solids from the well and carries them upward away from the bit and out of the well in a space (annulus) between the well walls and the drill string. At the top of the well, the solids-laden mud is discharged. In many instances, it is fed to one or more shale shakers which have one or more screens for screening the material. A wide variety of vibrating screens and devices that use them (shale shakers) are known. The screens catch and remove solids from the mud as the mud passes through them so that the now screened mud can be reused and pumped back down the drill string. If drilled solids are not removed from the drilling mud being used during the drilling operation, recirculation of the drilled solids can create weight, viscosity, and gel problems in the mud, as well as increasing wear on mud pumps and other mechanical equipment used for drilling.

In drilling a wellbore, the circulation of drilling fluid to and then away from the drill bit can cease due to the porosity of the formation and/or due to fracturing of the formation through which the wellbore is being drilled. This is referred to as "lost circulation." When lost circulation occurs, drilling fluid is pumped into the fractured formation, rather than being returned to the surface. Often circulation is lost at some specific depth where the formation is "weak", and where a fracture extends horizontally away from the borehole. Expressions used to describe rocks that are susceptible to lost returns include terms like "vugular" limestone, "unconsolidated" sand, "rotten" shale, and the like.

A wide variety of "lost circulation materials" have been developed and pumped into wellbores to fill or seal off a porous formation or to fill or seal off a wellbore fracture so that a proper route for drilling fluid circulation is re-established. For purposes of classification, some lost circulation materials may generally be divided into fibers, flakes, granules, and mixtures.

It is often desirable to retain the lost circulation material in the drilling mud system during continuous circulation. Screening the drilling mud in the usual manner for removal of undesired particulate matter (e.g., drilled solids) can also result in the removal of the lost circulation material. Such screening can therefore require continuous introduction of new lost circulation material to the drilling mud downstream of the mud screening operation.

The addition of the lost circulation material into the drilling fluid compounds the separating problems because it, like the drilling fluid, is often cleaned and recirculated. The drilling fluid exits the well with solids that include: (1) valuable small sized particles such as clay minerals and weighting minerals, (2) valuable lost circulation material of a large size, and (3) undesirable drilled solids that span sizes from coarser than lost circulation material to sizes of the smallest of the valuable materials in the fluid. The function of the lost circulation material is to seal openings or gaps in an earth formation. Unfortunately, this lost circulation material, when pumped back to the surface of the well and passed through mud cleaning apparatus at the surface, can plug up separator components, e.g. fine screen cloth on shale shaker screens. One proposed solution to this separation problem is a conventional two step screening process as shown in U.S. Pat. No. 4,116,288 in which an exiting mixture of drilling fluid, lost circulation material and undesirable material is first subjected to a coarse screening to separate the lost circulation material from the drilling fluid and undesirable material which drops to a second finer screen there below to separate the drilling fluid from the undesirable material. The drilling fluid and lost circulation material are then reunited for recirculation into the well. This system is susceptible to height restrictions and fine screen problems and can allow undesirable solids or pieces of cuttings or debris of the same size as lost circulation material to be circulated back into a well. Often the moist, fibrous lost circulation material will also be coated with finer undesirable material which will not go through a first screen and which is therefore circulated back into a well.

SUMMARY

Various techniques for controlling drilling fluid cleaning apparatus that reclaim lost circulation material from spent drilling fluid are disclosed herein. In one embodiment, a system includes a tank, a density separation device, and a fluid density control system. The tank holds spent drilling fluid containing drilling fluid, lost circulation material, coarse solids and fine solids. The density separation device is coupled to an outlet of the tank. The density separation device provides an overflow stream and an underflow stream. The overflow stream contains less dense material than the underflow stream. The fluid density control system is configured to adjust the density of the spent drilling fluid provided to the density separation device by recirculating a portion of the underflow stream into the tank.

In another embodiment, a method for cleaning drilling fluid includes providing a stream of spent drilling fluid. The stream of spent drilling fluid is separated into an overflow stream and an underflow stream. The underflow stream contains material of higher density than the overflow stream. The density of the spent drilling fluid in the stream is adjusted by recirculating a portion of the underflow stream into the spent drilling fluid.

In yet another embodiment, a system for cleaning drilling fluid includes a tank, a density separation device, a pump, and a fluid level control system. The tank is configured to hold spent drilling fluid. The density separation device is coupled to an outlet of the tank. The density separation device includes an overflow outlet to provide an overflow stream and an underflow outlet to provide an underflow stream. The underflow stream contains more dense material than the overflow stream. The pump is configured to move spent drilling fluid from the tank to the density separation device. The fluid level control system is configured to adjust the level of the spent drilling fluid in the tank to at least a predetermined level that prevents introduction of air into the pump.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct physical and/or electrical connection. Thus, if a first device couples to a second device, that connection may be through a direct physical and/or electrical connection, or through an indirect physical and/or electrical connection via other devices, components, and connections.

DETAILED DESCRIPTION

The following discussion is directed to various embodiments of the invention. Although one or more of these embodiments may presently be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

To reduce the need to introduce new lost circulation material ("LCM") into drilling fluid, recapture of LCM circulated through a wellbore is advantageous. Separation systems requiring that the LCM have a different size than wellbore cuttings may be inefficient because such a difference in size cannot be guaranteed. Embodiments of the present disclosure include a drilling fluid cleaning system that is configured to separate LCM and wellbore cuttings of the same size. A density/fluid shear separation device (e.g., a hydrocyclone) can be used to separate components of fluid stream based on the densities of the components. However, inconsistencies in the hydrocyclone feed stream can reduce the effectiveness of the hydrocyclone. Embodiments disclosed herein include control systems that enhance density/fluid shear separation by producing a feed stream that optimizes hydrocyclone performance.

Figure 1:
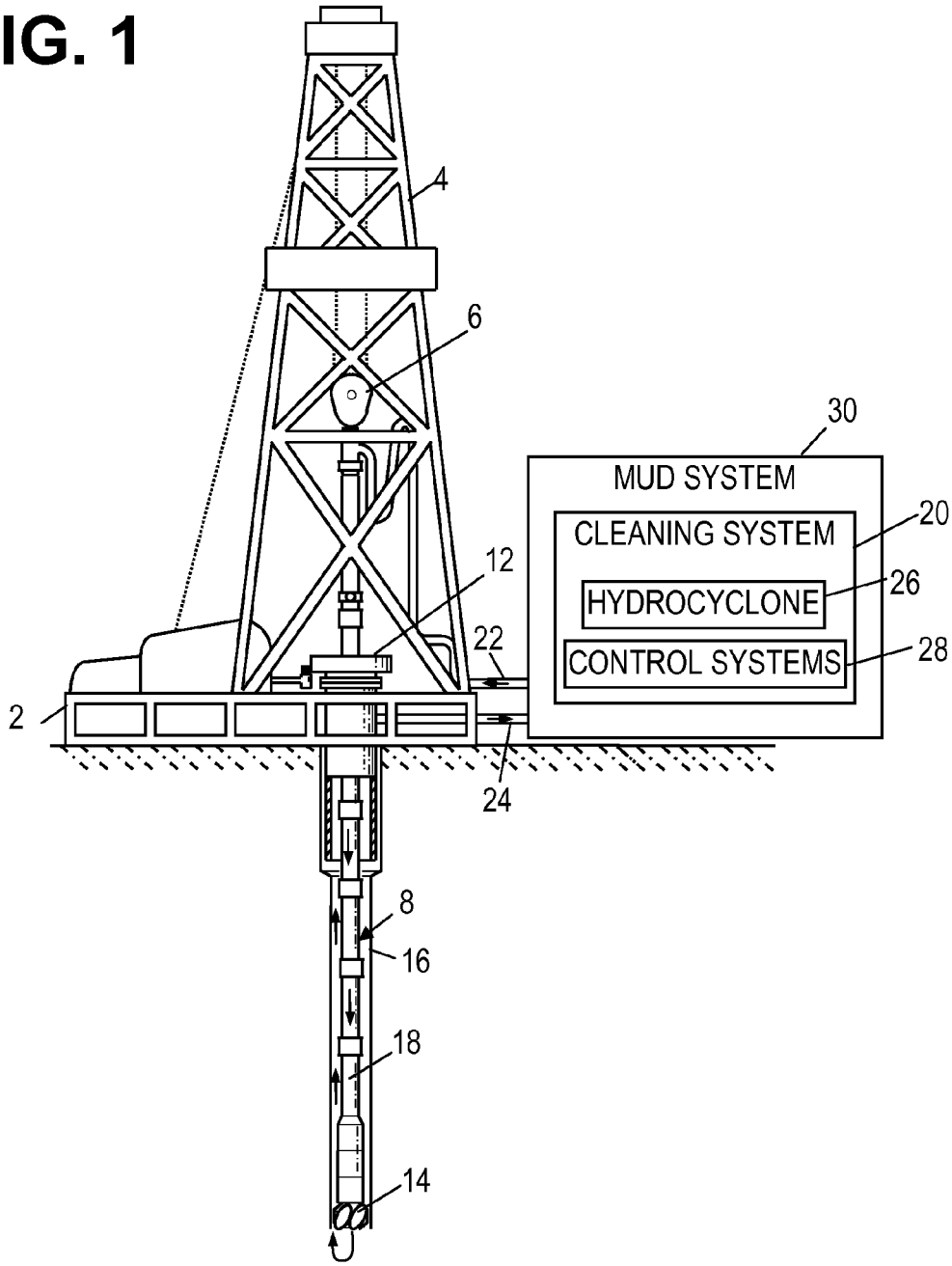
FIG. 1 shows a drilling system that includes a drilling fluid cleaning system in accordance with various embodiments.

FIG. 1 shows a drilling system that includes a drilling fluid cleaning system in accordance with various embodiments. A drilling platform 2 supports a derrick 4 having a traveling block 6 for raising and lowering a drill string 8. As bit 14 rotates, it creates a wellbore 16 that passes through various subsurface formations. A mud system 30 pumps drilling fluid including LCM through a feed pipe 22 downhole through the interior of drill string 8. The drilling fluid sprays through orifices in the drill bit 14 and returns to the surface via the annulus around drill string 8. The spent drilling fluid including LCM and wellbore cuttings is returned to the mud system 30 via pipe 24.

The mud system 30 includes a drilling fluid cleaning system 20. Embodiments of the cleaning system 20 may include size separation apparatus and density separation apparatus. Size separation apparatus (e.g., shale shakers) filter the spent fluid according to the size of particles being carried by the fluid. Density separation apparatus (e.g., hydrocyclone 26) filter fluid according to the density of the materials carried in the fluid. Embodiments disclosed herein provide effective separation according to density by controlling various parameters of the fluid flowing into the hydrocyclone 26. The control systems 28 may control the density and/or pressure of the drilling fluid flowing into the hydrocyclone 26, and may further control the level of drilling fluid stored in a reservoir from which the drilling fluid flows into the hydrocyclone 26. The control systems 28 coordinate to ensure that the hydrocyclone operates to provide density separation.

Figure 2:
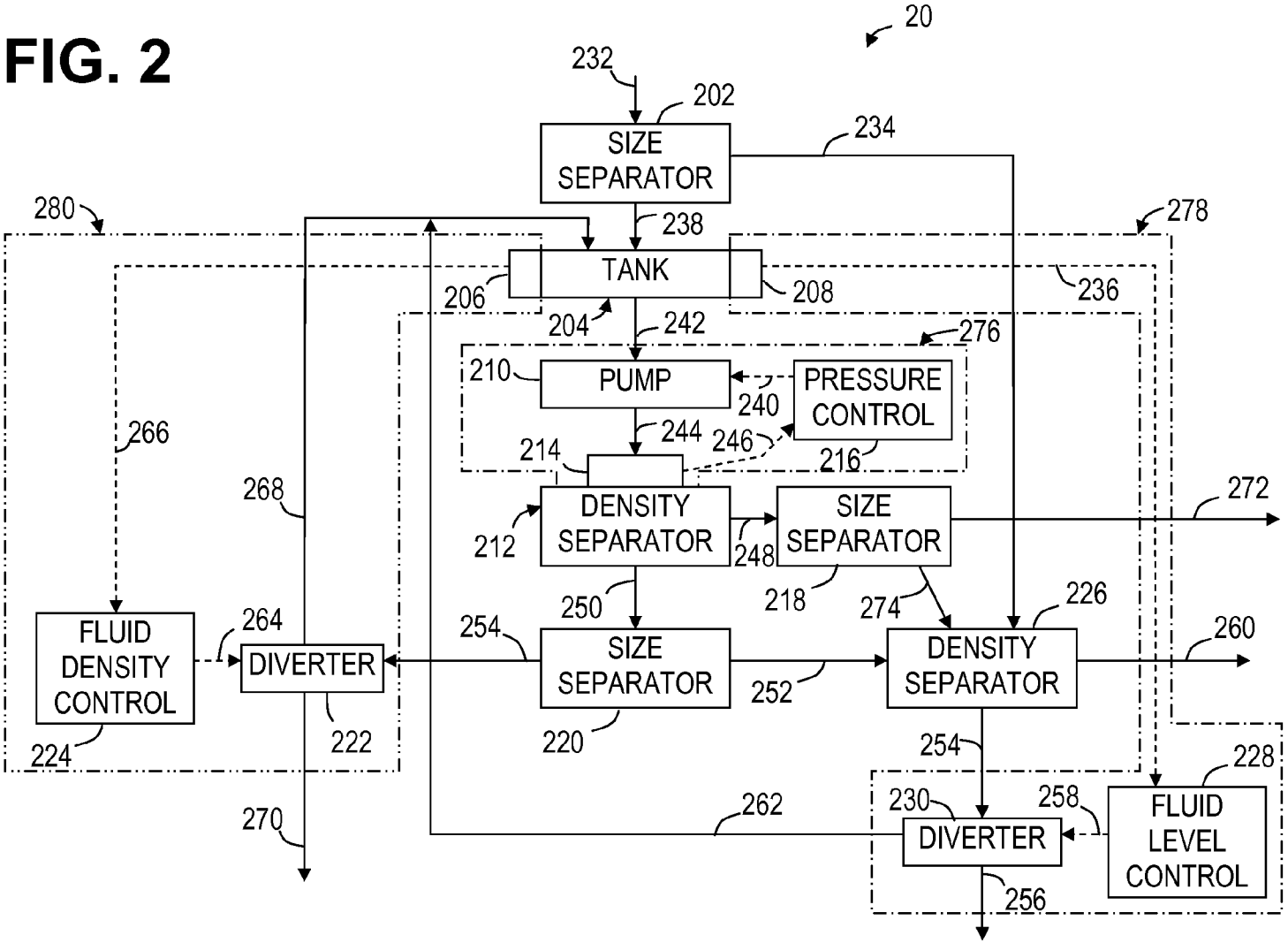
FIG. 2 shows a schematic diagram of a portion of a drilling fluid cleaning system in accordance with various embodiments.

FIG. 2 shows a schematic diagram of a portion of the drilling fluid cleaning system 20 in accordance with various embodiments. The cleaning system 20 includes a density/fluid shear separator 212, which may be a hydrocyclone 26 (FIG. 1) or similar device known to those skilled in the art, and control systems that are configured to optimize density separator 212 performance.

Spent drilling fluid 232 is returned from the wellbore 16 via the pipe 24 (FIG. 1). The spent drilling fluid 232 contains drilling fluid, drilled cuttings, debris, and LCM. A size separation device 202, such as a shale shaker, a sieve bend, or other separating device known to those skilled art for separating material from spent drilling fluid, applies a size separation to the spent drilling fluid 232. In some embodiments, the size separating device 202 includes two or more devices operating in parallel.

The size separating device 202 produces an undersize stream 234 of drilling fluid and fine undesirable solids, and a stream 238 of coarse undesirable solids along with a small amount of drilling fluid. In some embodiments, the size separating device 202 may be configured to select solids finer than the finest size of the LCM for inclusion in the undersize stream 234. Thus, LCM is provided in the stream 238 along with coarse undesirable solids. The stream 238 may be stored in a reservoir or tank 204 in preparation for further processing.

A pump 210 is coupled to an outlet of the tank 204 and provides a stream 244 to the density/fluid shear separation device 212. Embodiments of the cleaning system 20 include control systems configured to regulate the stream 244 provided to the density separator 212, and to thereby enhance the operation of the density separator 212. Some embodiments of the cleaning system 20 include a fluid density control system 280, and/or a fluid pressure control system 276, and/or a level control system 278 for tank 204.

The density separator 212 produces an underflow stream 250 and an overflow stream 248. When the density separator 212 is separating as desired, LCM is directed to the overflow stream 248, which is directed to a size separator 218 (e.g., another shaker). The size separator 218 produces an oversize stream 272 including LCM that may be recirculated into the active mud system and pumped in the wellbore 16, and undersize stream 274 including drilling fluid and a small amount of undesirable solids.

Unfortunately, if there is an insufficient volume of coarse particles in the feed stream 244 to fill the underflow capacity of the density separator 212 and displace LCM particles into the overflow stream 248, then the underflow stream 250 will contain LCM particles. The underflow stream 250 is passed to a size separator 220 (e.g., another shaker). The size separator 220 processes the underflow stream 250 to produce a stream 254 including coarse solids and LCM, and a stream 252 including drilling fluid and fine undesirable solids.

Embodiments of the cleaning system 20 include a fluid density control system 280 configured to adjust the density of the fluid stored in the tank 204. The fluid density control system 280 re-directs coarse particles and LCM separated from the overflow stream 250 back to the tank 204 until the density of the fluid stored in the tank 204 is sufficient to promote proper separation of LCM in the density separator 212 (i.e., to separate LCM into overflow stream 248). The fluid density control system 280 includes a fluid density sensor 206 coupled to the tank 204, a controller 224, and a diverter 222. The fluid density sensor 206 measures the density of the fluid in the tank 204 and provides a signal 266 indicative of the measured fluid density to the controller 224. A suitable fluid density sensor includes, for example, the TSG500 by Forerunner Technologies LLC. The diverter 222 (e.g., a diverter plate) controls the flow of material from stream 254 back to the tank 204. The diverter 222 is variably positionable to recirculate any portion of the stream 254 to the tank 204. The controller 224 compares the measured density value 266 provided by the density sensor 206 to a predetermined desirable density value and sets the diverter 222 (via control signal 264) to provide a portion 268 of the stream 254 to the tank 204. The predetermined desirable density value may be indicative of a fluid density conducive to separating LCM into the overflow stream 248. The density of the fluid in the tank 204 (i.e., the fluid provided to the density separator 212) is changed in accordance with the portion of the stream 254 recirculated into the tank 204. The controller 224 sets the diverter 222 to increase or decrease the density of the fluid in the tank 204 to the predetermined desirable density value, or to maintain the density of the fluid in the tank 204 at the predetermined desirable density value. A portion of the stream 254 not recirculated to the tank 204 is provided to the stream 270 and may be discarded.

In the density separator 212, the stream 244 enters tangentially through an inlet forcing the spent drilling fluid to form a vortex inside the separator 212. The fluid accelerates as it flows down through the separator 212. Forces created by the spinning motion of the fluid cause higher density materials to separate from the fluid and travel down to the underflow outlet of the separator 212 while lower density components of the spent drilling fluid (e.g., drilling fluid and LCM) migrate towards the center of the separator 212 and out of the overflow outlet. However, if the pressure of the stream 244 at the density separator 212 inlet is insufficient to create enough centripetal acceleration of the feed material to promote separation, then the feed material drains through the underflow outlet of the density separator 212 and no separation occurs.

Embodiments of the cleaning system 20 include a pressure control system 276 to adjust the pressure of the stream 244 at the density separator 212 inlet. The pressure control system 276 includes a pressure sensor 214 (e.g., a TD1000 by Transducers Direct) coupled to the inlet of the density separator 212, a pump 210, and a controller 216. The pressure sensor 214 measures the pressure of the stream 244 at the inlet of the density separator 212 and provides a signal 246 indicative of the measured pressure to the controller 216. The controller 216 compares the measured pressure value 246 to a predetermined desirable pressure value, and based on the comparison provides control signal 240 to the pump 210. The control signal 240 changes the operating parameters (e.g., speed) of the pump 210 to raise or lower the pressure of the stream 244 at the separator 212 inlet bring the pressure towards the predetermined desirable pressure value.

Centrifugal feed pumps (e.g., pump 210) require a sufficient level of fluid above the pump inlet (e.g., the tank 204 outlet) to prevent air from being introduced in the pump. Air introduced to the pump reduces flow rate and consequently reduces the pressure of the stream 244 entering the density separator 212. In some cases, cyclical surging can occur as air blocks the operation of the pump, causing the tank level to rise. The increased pressure of the rising tank level displaces the blocking air, and fluid from the tank enters the pump causing a surge in flow that decreases the tank level and again introduces air into the pump. Additionally, the density separator 212 may perform better when the stream 244 includes more than a minimum predetermined concentration of liquid. The liquid enables the various types of solids to move past one another more freely when centripetal acceleration begins to affect the fluid in the density separator 212.

Embodiments of the cleaning system 20 include a tank level control system 278 configured to adjust the level of drilling fluid in the tank 204. The tank level control system 278 provides a stream of drilling fluid 262 to the tank 204 until the level of the fluid in the tank 204 is at least a predetermined level sufficient to prevent air from being introduced into the pump 210. The tank level control system 278 includes a level sensor 208 (e.g.,an E4PA-N by Omron Electronics LLC or an RPS-409A-40-IS by Migatron Corporation) coupled to the tank 204, a diverter 230, and a controller 228. The level sensor 208 measures the level of spent drilling fluid in the tank 204 and provides a signal 236 indicative of the measured tank 204 fluid level to the controller 228. The diverter 230 controls the flow of drilling fluid stream 262 to the tank 204. In the embodiment of FIG. 2, the diverter 230 is coupled to a density separator 226 (e.g., a centrifugal separator) that processes one or more undersize streams 234, 252, 274 from size separators 202, 220, 218. The density separator 226 produces cleaned drilling fluid stream 254 and fine solids stream 260. The fine 260 solids may be discarded. The controller 228 modulates the diverter 230 to allow a portion of the cleaned fluid stream 254 to flow into the tank 204.

The diverter 230 may be a pump, a valve, an actuator, etc. If the diverter 230 comprises a pump, then the controller 228 may provide a control signal 258 that sets an operating parameter (e.g., speed) of the pump in accordance with the measured fluid level 236 and the predetermined desirable fluid level to adjust the level of fluid in the tank 204. If the diverter 230 is a valve or actuator, then the controller 228 may provide a control signal 258 that opens the valve or sets the actuator to pass fluid to adjust the level of fluid in the tank 204 in accordance with the measured fluid level 236 and the predetermined desirable fluid level. Portions of the stream 254 not passed to stream 262 for recirculation to the tank 204 may be routed to stream 256 for use in the active mud system.

Embodiments of the controllers 224, 216, and 228 may be implemented as one or processors executing software programming that configures the processors to perform the control functions described above based on the described sensor measurement values and corresponding predetermined desirable values. A processor suitable for implementing the controllers 224, 216, 228 may be a general-purpose processor, digital signal processor, microcontroller, etc. Processor architectures generally include execution units (e.g., fixed point, floating point, integer, etc.), storage (e.g., registers, memory, etc.), instruction decoding, data routing (e.g., buses), etc. Software programming may be stored in a computer readable storage medium accessed by the one or more processors. A suitable computer readable storage medium may be a semiconductor memory, magnetic storage device, optical storage device, etc. Some embodiments of the controllers 224, 216, 228 may be implemented as dedicated circuitry.

Embodiments of the controllers 224, 216, and 228 may implement various control algorithms to perform the functions described above. For example, some embodiments of the controllers 224, 216, and 228 may be implemented as bang-bang controllers, and some other embodiments may be implemented as proportional-integral-derivative controllers, or other controller implementations known to those skilled in the art.

In some embodiments of the cleaning system 20, the response rate of the fluid level control system 278 is faster than the response rate of the pressure control system 276 and the response rate of the density control system 280. In some embodiments of the cleaning system 20, the response rate of the density control system 280 is slower than the response rate of the pressure control system 276 and the response rate of the fluid level control system 278. In some embodiments of the cleaning system 20, the response rate of the fluid level control system 278 is faster than the response rate of the pressure control system 276 and the response rate of the pressure control system 276 is faster than the response rate of the density control system 280.

The size separators 202, 218, and 220 may be, for example, KING COBRA shakers, MINI COBRA shakers, or VSM shakers from National Oilwell Varco, or another such separator known in the art. The density separator 226 may be, for example, a Brandt HS-3400, HS-1960, HS-2172, or HS 2000 from National Oilwell Varco, or another such separator known in the art.

Figure 3:
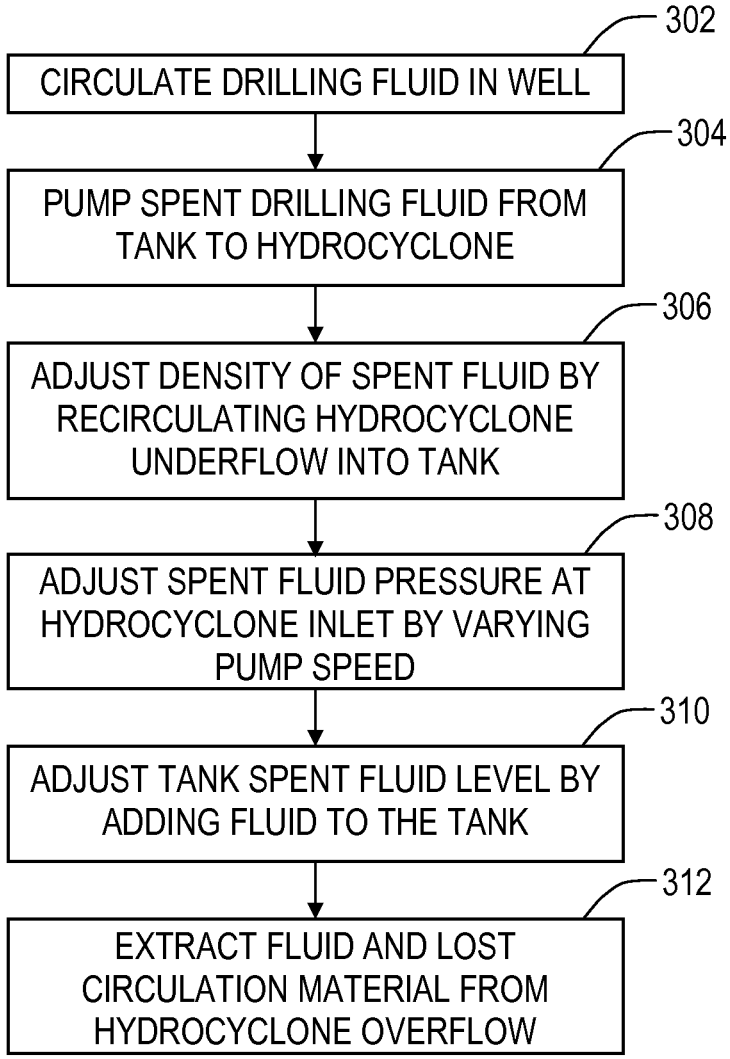
FIG. 3 shows a flow diagram for a method for cleaning drilling fluid in accordance with various embodiments.

FIG. 3 shows a flow diagram for a method for cleaning drilling fluid in accordance with various embodiments. Though depicted sequentially as a matter of convenience, at least some of the actions shown can be performed in a different order and/or performed in parallel. Additionally, some embodiments of the cleaning system 20 may perform only some of the actions shown. In some embodiments, the operations of FIG. 3, as well as other operations described herein, can be implemented as instructions stored in a computer-readable medium and executed by one or more processors, or performed and/or controlled by dedicated circuitry.

In block 302, the mud system 30 is operating and is circulating drilling fluid in the wellbore 16. The mud cleaning system 20 is operating to remove undesirable solids, such as wellbore cuttings from the drilling fluid extracted from the wellbore 16. The mud cleaning system 20 is reclaiming LCM from the fluid extracted from the well for addition to clean fluid to be injected into the drill string 8.

In block 304, spent drilling fluid (i.e., drilling fluid extracted from the wellbore 16 that includes solids, such as cuttings and LCM) is pumped from a holding tank 204 to a density/fluid shear separator 212, such as a hydrocyclone. The density separator 212 operates to separate components of the spent drilling fluid into an underflow stream 250 and an overflow stream 248 according to the density of the components. When the density separator 212 is operating effectively, the overflow stream 248 includes lower density components and the underflow stream 250 includes higher density components.

To enhance operation of the density separator 212, embodiments include control systems that optimize the fluid stream 244 provided to the density separator 212. Systems lacking such control systems may not efficiently isolate LCM from the spent drilling fluid, resulting in a loss of LCM.

In block 306, a fluid density control system 280 adjusts the density of the spent drilling fluid stored in the tank 204. If the stream 244 provided to the density separator 212 includes insufficient high density components to promote separation of LCM into the overflow stream 248, LCM may be directed to the underflow stream 250. The fluid density control system 280 measures (via a density sensor 206 in the tank 204) the density of the spent drilling fluid stored in the tank 204, compares the measured density value to a predetermined desired density value, and recirculates a portion of the density separator underflow stream 250 (i.e., the denser components of the stream 244) into the tank 204 to adjust the fluid density. By ensuring provision of sufficient high density components in the stream 244, embodiments promote efficient separation of LCM into the overflow stream 248.

In block 308, a fluid pressure control system adjusts the pressure of the fluid stream 244 provided to the density separator 212. If the pressure of the stream 244 provided to the density separator 212 is too low, then the fluid in the density separator 212 may be subject to insufficient centripetal acceleration to cause separation of components. The fluid pressure control system 276 measures (via a pressure sensor 214 at the density separator 212 inlet) the pressure of the stream 244, compares the measured pressure value to a predetermined desired pressure value, and sets the speed of the pump 210 to achieve the predetermined desired pressure. By ensuring adequate pressure of the stream 244 at the inlet of the density separator 212, the fluid pressure control system 276 provides for efficient separation of high and low density components of the stream 244.

In block 310, a tank level control system adjusts the level of the spent drilling fluid stored in the tank 204. If the level of fluid in the tank is too low, air may be introduced into the stream 242 and the pump 210, resulting in a loss of pressure and/or undesirable pressure oscillations at the density separator 212. The tank level control system 278 measures (via a fluid level sensor 208 in the tank 204) the level of fluid held in the tank 204, compares the measured level value to a predetermined desired level value, and directs fluid into the tank to adjust the fluid level. The fluid directed into the tank may be provided from any of a variety of fluid sources. For example, fluid may be provided from a density separator 254 or from other sources in the mud system 30. By controlling the level of fluid in the tank 204, embodiments allow a consistent stream at a consistent pressure to be provided to the density separator 212, thereby promoting efficient density/fluid shear separation.

In block 312, fluid 256 and lost circulation material 272 are respectively being extracted from the spent drilling fluid by size separator 218 and density separator 226 for recirculation into the wellbore 16. Undesirable solids 270, 272 are being separated from the spent drilling fluid and discarded.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A system for cleaning drilling fluid, comprising:

a tank configured to hold spent drilling fluid;

a density separation device coupled to an outlet of the tank, the density separation device providing an overflow stream and an underflow stream, wherein the overflow stream contains less dense material than the underflow stream;

a fluid density control system configured to adjust density of the spent drilling fluid provided to the density separation device by recirculating a portion of underflow stream into the tank; and a sizing apparatus that receives the underflow stream from the density separation device, the sizing apparatus configured to separate coarse solids from the underflow stream; wherein the portion of the underflow stream recirculated into the tank comprises the coarse solids separated from the underflow stream.

2. The system of claim 1, wherein the fluid density control system comprises:

a fluid density sensor disposed in the tank, the fluid density sensor configured to provide a measurement value corresponding to the density of the spent drilling fluid held in the tank;

a diverter configured to route the portion of the underflow stream to the tank; and a controller configured to adjust the density of the spent drilling fluid in the tank to a predetermined density value by setting the diverter to route the portion of the undertow stream based on the measurement value and the predetermined density value.

3. The system of claim 1, further comprising a feed pressure control system configured to maintain centripetal acceleration of the spent drilling fluid in the density separation device by adjusting a pressure of the spent drilling fluid provided from the tank to the density separation device.

4. The system of claim 3, wherein the feed pressure control system comprises:

a pump coupled to the outlet of the tank, the pump configured to provide spent drilling fluid to the density separation device;

a pressure sensor coupled to an inlet of the density separation device that receives the spent drilling fluid from the tank, the pressure sensor configured to provide a measurement value corresponding to a pressure of the spent drilling fluid at the inlet; and a controller configured to adjust the pressure of the spent drilling fluid at the inlet to a predetermined pressure value by changing an operating parameter of the pump based on the measurement value and predetermined pressure value.

5. The system of claim 1, further comprising a level control system configured to prevent introduction of air into a density separation device feed pump coupled to the outlet of the tank by maintaining a minimum predetermined level of spent drilling fluid in the tank.

6. The system of claim 5, wherein the level control system comprises:

a level sensor disposed in the tank, the level sensor configured to provide a measurement value corresponding to a level of the spent drilling fluid in the tank;

a drilling fluid source; and a controller configured to adjust the level of the spent drilling fluid in the tank to at least a predetermined level value by controlling a flow of drilling fluid from the drilling fluid source to the tank based on the measurement value and the predetermined level value.

7. The system of claim 6, wherein the drilling fluid source comprises a separating apparatus that receives the overflow stream from the density separation device, the separating apparatus configured to separate lost circulation material from the overflow stream.

8. A method for cleaning drilling fluid, comprising:

providing a stream of spent drilling fluid;

separating the stream of spent drilling fluid into an overflow stream and an underflow stream, wherein the underflow stream contains material of higher density than the overflow stream;

adjusting a density of the spent drilling fluid in the stream by recirculating a portion of the underflow stream into the spent drilling fluid;

measuring a pressure of the stream of spent drilling fluid;

comparing the measured pressure to a predetermined pressure; and adjusting an operational parameter of a pump providing the stream of spent drilling fluid to change the measured pressure toward the predetermined pressure.

9. The method of claim 8, wherein the adjusting comprises:

measuring the density of the spent drilling fluid;

comparing the measured density of the spent drilling fluid to a predetermined density; and controlling an amount of the underflow stream being recirculated into the spent drilling fluid to adjust the measured density towards the predetermined density.

10. The method of claim 8, further comprising adjusting a pressure of the stream of spent drilling fluid at an inlet of a hydrocyclone, thereby controlling centripetal acceleration of the spent drilling fluid in the hydrocyclone.

11. The method of claim 8, further comprising adjusting a level of spent drill fluid held in the tank based on a predetermined level that prevents introduction of air into a pump impelling the stream of spent drilling fluid to the hydrocyclone.

12. The method of claim 8, further comprising:

measuring the level of spent drilling fluid in the tank;

comparing the measured level to the predetermined level; and providing, responsive to the comparing, drilling fluid to the tank thereby increasing the level of spent drilling fluid toward the predetermined level.

13. A system for cleaning drilling fluid, comprising:

a tank configured to hold spent drilling fluid;

a density separation device coupled to an outlet of the tank, the density separation device including an overflow outlet to provide an overflow stream and an underflow outlet to provide an underflow stream, wherein the underflow stream contains more dense material than the overflow stream;

a pump configured to move spent drilling fluid from the tank to the density separation device; and a fluid level control system configured to adjust a level of the spent drilling fluid in the tank to at least a predetermined level that prevents introduction of air into the pump, the fluid level control system comprising:

a level sensor disposed in the tank, the level sensor configured to provide a measurement value corresponding to a level of the spent drilling fluid in the tank:

a drilling fluid source;

a flow regulator configured to control flow of drilling fluid from the drilling fluid source to the tank; and a controller configured to control the flow regulator to adjust the level of the spent drilling fluid in the tank toward the predetermined level based on the measurement value and the predetermined level.

14. The system of claim 13 wherein the drilling fluid source is at least one of drilling fluid extracted from the overflow stream and a reservoir of fresh drilling fluid.

15. The system of claim 13, further comprising a fluid density control system, the fluid density control system comprising:

a fluid density sensor disposed in the tank, the fluid density sensor configured to provide a measurement value corresponding to the density of the spent drilling fluid held in the tank;

a diverter coupled to the underflow outlet, the diverter configured to route a portion of the underflow stream to the tank; and a controller configured to adjust the density of the spent drilling fluid in the tank to a predetermined density value by setting the diverter to route the portion of the undertow stream to the tank based on the measurement value and the predetermined density.

16. The system of claim 13, further comprising a feed pressure control system, the feed pressure control system comprising:

a pressure sensor coupled to an inlet of the density separation device that receives the spent drilling fluid from the tank, the pressure sensor configured to provide a measurement value corresponding to a pressure of the spent drilling fluid at the inlet; and a controller configured to adjust the pressure of the spent drilling fluid at the inlet to a predetermined value by changing an operational parameter of the pump based on the measurement value and the predetermined value.

17. The system of claim 13, further comprising:

a first sizing apparatus coupled to the overflow outlet, the first sizing apparatus configured to separate lost circulation material from the overflow stream; and a second sizing apparatus coupled to the underflow outlet, the second sizing apparatus configured to separate coarse solids from the underflow stream, wherein a portion of the coarse solids are recirculated to the tank.

* * * * *